United States Patent [19]

Kroll

[11] 3,947,915

[45] Apr. 6, 1976

[54] STEEL WOOL PADS AND HOLDER THEREFOR

[76] Inventor: Florence Kroll, 879 E. 19th St., Brooklyn, New York, N.Y. 10009

[22] Filed: Nov. 13, 1974

[21] Appl. No.: 523,256

[52] U.S. Cl. ..... 15/209 D; 15/151

[51] Int. Cl.[2] ..... A47L 13/04

[58] Field of Search..... 15/147 C, 148, 150, 151, 15/154, 209 AH, 228, 229 AP, 229 BP, 244 R, 244 CH; 401/201, 203, 204

[56] References Cited

UNITED STATES PATENTS

| | | | |
|---|---|---|---|
| 748,367 | 12/1903 | Haight | 15/150 UX |
| 1,469,568 | 10/1923 | Williams | 15/228 |
| 1,679,392 | 8/1928 | Applin | 15/209 AH |
| 1,783,775 | 12/1930 | Boehler | 15/209 AH |
| 2,710,420 | 6/1955 | Granat et al. | 15/244 X |
| 3,034,165 | 5/1962 | Christian | 15/151 X |
| 3,161,905 | 12/1964 | Dryden | 401/204 |
| 3,495,918 | 2/1970 | Leland | 401/201 |
| 3,837,031 | 9/1974 | Allaire | 15/150 |

*Primary Examiner*—Daniel Blum
*Attorney, Agent, or Firm*—Lawrence E. Sklar

[57] ABSTRACT

A scrub-tool holder for steel wool comprising an elongated handle, a frame support means at one end of the handle and clamping means. The frame support means is adapted to support a steel wool pad having a slit through the center thereof and to extend through the slit in the pad so as to engage the edge walls of the slit, thereby leaving substantial overlying interior portions of the upper and lower reaches of the pad in contact with one another. The clamping means comprises rigid plate means adapted to engage the upper reach of the pad for holding the pad between the clamping means and frame support means and for urging the overlying interior portion of the upper reach of the pad against the contacting interior portion of the lower reach of the pad so as to provide added cushioning for the interior portion of such lower reach and to position the interior portion of the lower reach closer to the surface to be scrubbed.

11 Claims, 5 Drawing Figures

Fig. 4.
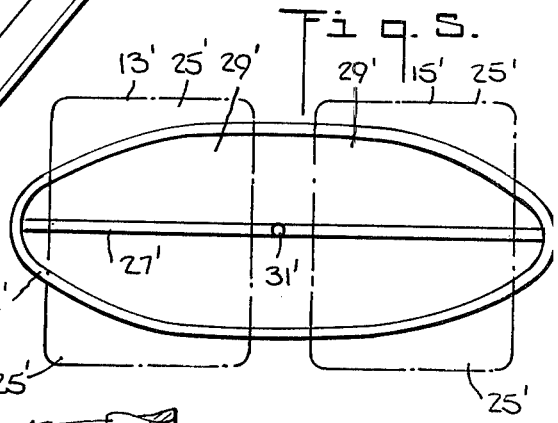
Fig. 5.
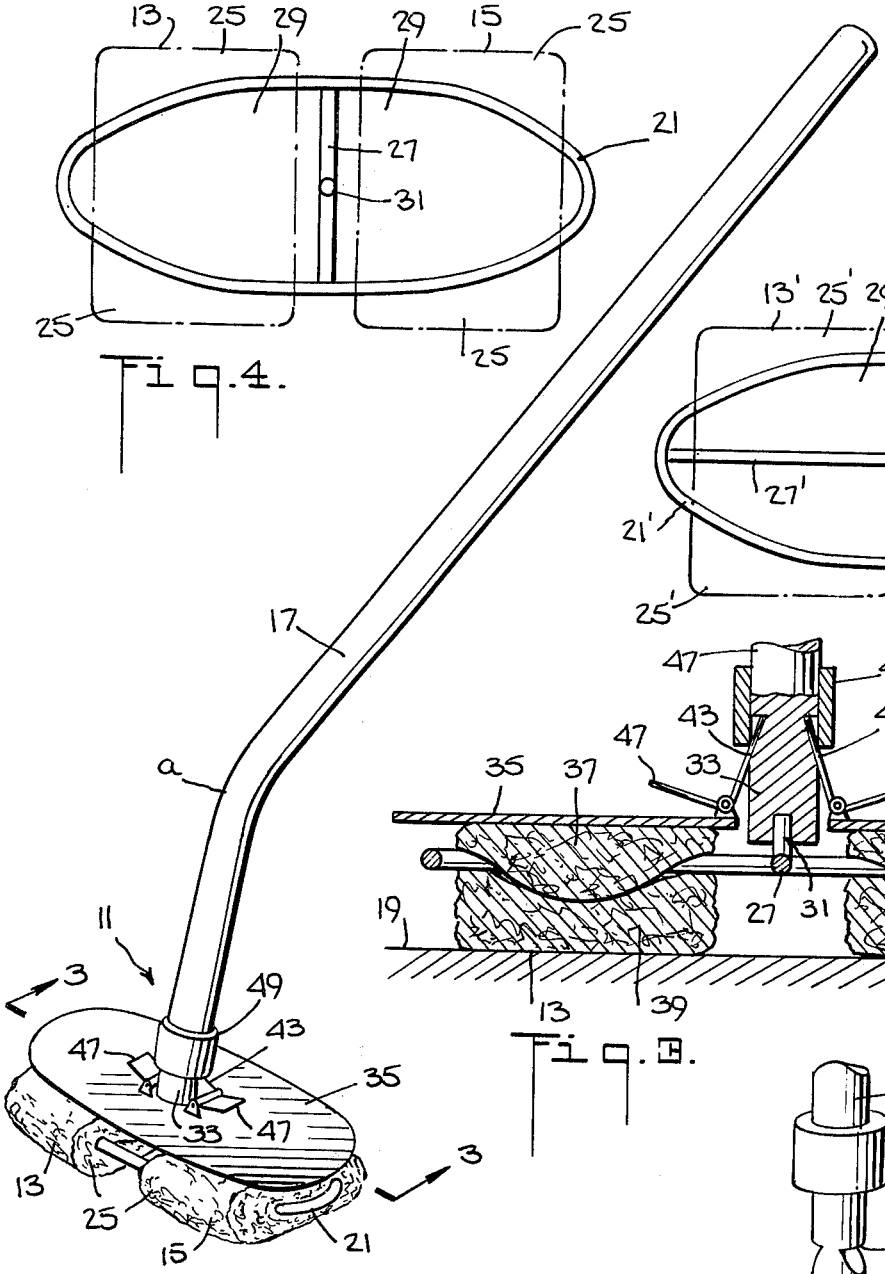
Fig. 1.
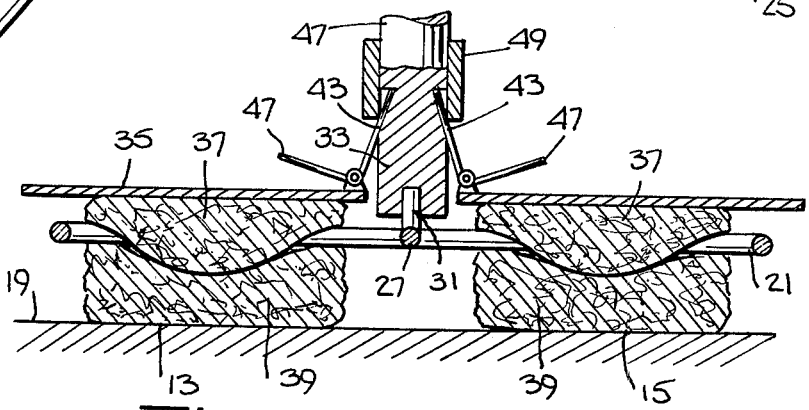
Fig. 3.
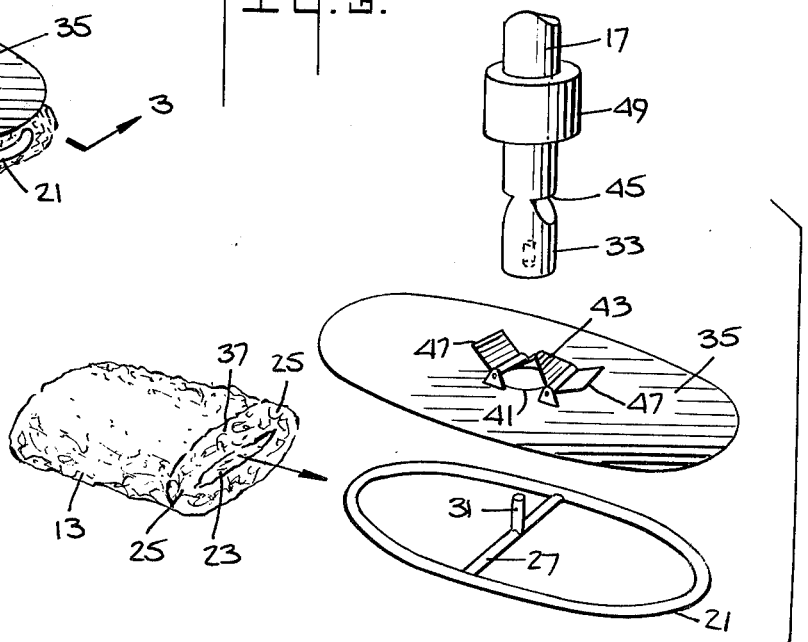
Fig. 2.

STEEL WOOL PADS AND HOLDER THEREFOR

BACKGROUND OF THE INVENTION

The instant invention relates to a scrub-tool holder for steel wool, and more particularly to such a holder having an elongated handle and a frame support which allows the interior portion of a steel wool pad to be substantially unsupported.

Direct handling of steel wool is both uncomfortable and injurious to the hand, making holders for steel wool a helpful device. Holders for steel wool must have not only flexibility but also the capability of urging the steel wool pad to close contact with the surface to be scrubbed. In U.S. Pat. No. 1,783,775 issued Dec. 2, 1930, there is disclosed a holder for use with a steel wool pad which appears to offer some degree of flexibility. However, as can be seen from the drawings therein, a supporting strap runs substantially through the entire length and width of the opening in the steel wool pad, so that the pad is virtually bisected in cross-sectional area. The bisecting has the effect of causing the steel wool pad to function substantially as only one half of a steel wool pad, with a concomitant loss in flexibility, cushioning and capability of urging the steel pad into closer contact with the surface to be scrubbed.

SUMMARY OF THE INVENTION

It is therefore an object of the instant invention to provide a holder for a steel wool pad that permits the pad to function as an integral unit and thereby provide substantially the same flexibility, cushioning and capability for urging the pad into closer contact with the surface to be scrubbed that exists when the pad is used without a holding device. To these ends, there is provided a scrub-tool holder for steel wool which comprises an elongated handle, frame support means at one end of said handle adapted to support a steel wool pad having a slit through the center thereof, said frame support means adapted to extend through the slit in the pad so as to engage the edge walls of the slit, thereby leaving substantial overlying interior portions of the upper and lower reaches of the pad in contact with one another, and clamping means for holding the pad fixed to the frame support means, said clamping means comprising rigid plate means adapted to engage the upper reach of the pad for holding the pad between the clamping means and the support frame means and for urging the overlying interior portion of the upper reach of the pad against the contacting interior portion of the lower reach of the pad so as to provide added cushioning for the interior portion of such lower reach and to position the interior portion of the lower reach closer to the surface to be scrubbed.

BRIEF DESCRIPTION OF THE DRAWINGS

FIG. 1 is a perspective view of the scrub-tool holder for steel wool pads according to the present invention.

FIG. 2 is an enlarged, exploded view of the holder shown in FIG. 1.

FIG. 3 is a cross-sectional view taken on the plane indicated by the line 3—3 in FIG. 1.

FIG. 4 is a top plan view of the steel wool pads and frame support therefor.

FIG. 5 is a top plan view of the steel wool pads and an alternative embodiment of the frame support therefor.

DESCRIPTION OF THE PREFERRED EMBODIMENT

In describing the preferred embodiment of the instant invention, reference is made to the drawings wherein FIG. 1 depicts a scrub-tool holder generally designated 11 supporting a pair of steel wool pads 13 and 15. The holder 11 includes an elongated handle 17 having a bend at point a in order to maintain the pads 13 and 15 on the surface 19 (see FIG. 3) to be scrubbed. The steel wool pads 13 and 15 are held on the scrub-tool holder 11 by means of an oval wire frame support 21 which extends through the substantially rectangular slit 23 (see FIG. 2) in the pads 13 and 15 so as to engage the edge walls 25 of the slit 23. The frame support 21 includes a central reinforcing bar 27 extending transversely with respect to the lengthwise direction of the supporting frame 21. As best seen in FIG. 4, the interior portions 29 of each of the steel wool pads 13 and 15 are unsupported.

Extending upwardly from the center of the reinforcing bar 27 is a cylindrical projection 31 which is received and held in the lower portion 33 of the handle 17. Situated above the frame support 21 is a rigid, oval clamping plate 35 which engages the upper reaches 37 (see FIG. 3) of the pads 13 and 15. The clamping plate 35 holds the pads 13 and 15 between the plate 35 and the support frame 21 and urges the overlying interior portions 29 of the upper reaches 37 against the interior portions 29 of the lower reaches 39 of the pads 13 and 15 so as to provide added cushioning for the interior portions 29 of such lower reaches 39 and to position such interior portions 29 of the lower reaches 39 closer to the surface 19 to be scrubbed. As best seen in FIGS. 3 and 4, the overlying interior portions 29 of the upper reaches 37 and lower reaches 39 are in contact with one another.

The clamping plate 35 includes an aperture 41 (see FIG. 2) which allows the plate 35 to slide up and down handle 17. Mounted on the clamping plate 35 adjacent the aperture 41 are a pair of spring-loaded fingers 43 which prevent the clamping plate 35 from moving up along handle 17 once the plate 35 has depressed the tops of the pads 13 and 15 and the fingers 43 have engaged the shoulders 45 of the handle 17 situated adjacent the top of the lower portion 33 of the handle 17. A pair of release tabs 47 are secured to the fingers 43 to facilitate release of the fingers 43 from engagement with the shoulder 45. Slidably mounted over the handle 17 is a locking ring-slide 49 which prevents disengagement of the spring-loaded fingers 43 from their engaged position during the scrubbing procedure and which only need be moved upwardly along the handle 17, clear of the shoulders 45, in order to permit the release tabs 47 to be depressed to disengage the fingers 43 from the shoulders 45, thereby permitting the clamping plate 35 to be moved upwardly and away from the supporting frame 21 so that the steel wool pads 13 and 15 may be slipped onto or removed from the wire frame support 21.

Although the reinforcing bar 27 is shown as being transverse to the length of the supporting frame 21, it is also possible to employ a reinforcing bar that is longitudinal with respect to the length of the supporting frame 21 as shown in FIG. 5. In this alternative embodiment, substantial overlying interior portions 29 of the upper reaches 37 and lower reaches 39 are in contact with one another, since only the areas of interior portions 29 of the pads 13 and 15 adjacent the reinforcing bar 27' lack upper and lower reaches in contact with one another. It should also be noted that the interior portions 29 of each of the steel wool pads 13 and 15 are substantially unsupported.

The invention disclosed will have many modifications which will be apparent to those skilled in the art in view of the teachings of the specifications. It is intended that all modifications which fall within the true spirit and scope of this invention be included within the scope of the appended claims.

What is claimed is:

1. In combination a scrub-tool holder and a steel wool pad, said pad having upper and lower reaches and a slit through the center thereof defining overlying interior portions, comprising:

an elongated handle;

an open frame support means at one end of said handle adapted to support said steel wool pad, said frame support means having at least one end portion spaced from said handle and being tapered toward said end portion and adapted to extend through the slit in the pad so as to engage the edge walls of said slit, thereby leaving substantially all of the overlying interior portions of the upper and lower reaches of the pad in contact with one another; and clamping means comprising rigid plate means on said handle mounted for reciprocal movement towards and away from the frame support means for fixedly holding on said frame support means a pad previously applied thereto and for urging the overlying interior portion of the upper reach of the pad against the contacting interior portions of the lower reach of the pad so as to provide added cushioning for the interior portion of the lower reach and to position the interior portion of the lower reach closer to the surface to be scrubbed.

2. The combination of claim 1, wherein the frame support means comprises a wire frame having a central reinforcing bar fixing said frame support means to said handle, the wire frame support means having a pair of end portions each spaced from said handle and each tapered in the direction from the handle towards the respective end portion and adapted to support respectively a pair of steel wool pads, one on each side of the handle.

3. The combination of claim 2, wherein the rigid plate means comprises an elongated plate being tapered toward its opposite end portions thereof and mounted on said handle for said reciprocal movement along the handle toward and away from said frame support means, whereby the steel wool pads may be slipped onto or removed from the opposite end portions, respectively, of said wire frame support when the rigid plate is spaced from the wire frame support.

4. The combination of claim 3, wherein the handle includes shoulders on the lower portion of the handle, and additionally comprising a pair of spring-loaded fingers mounted on the rigid clamping plate, said fingers being adapted to engage the handle shoulders, whereby the clamping plate may be locked into clamping engagement with the upper reaches of the steel wool pads.

5. The combination of claim 1, wherein the handle includes a bend in the vertical plane in order to maintain the steel wool pads flat on the surface to be scrubbed.

6. The combination of claim 1, wherein the slit through the center of the steel wool pad is substantially rectangular.

7. The combination of claim 1, wherein the frame support means comprises an oval shaped wire frame having a central reinforcing bar, the oval wire frame support means being adapted to support a pair of steel wool pads one at each end of the reinforcing bar.

8. In combination, a pair of steel wool pads each having upper and lower reaches and a slit through the center thereof defining overlying interior portions and a scrub-tool holder for supporting said steel wool pads, said scrub-tool holder comprising an elongated handle, open, elongated frame support means at one end of said handle, said frame support means having opposite end portions respectively at opposite sides of and spaced from said end of said handle, said frame support means being tapered toward its end portions and adapted to extend through the slits in the pads so as to engage the edge walls of said slit, thereby leaving substantially all of the overlying interior portions of the upper and lower reaches of the pads in contact with one another, and clamping means comprising rigid plate means adapted to engage the upper reaches of the pads for holding the pads between said clamping means and said frame support means and for urging the overlying interior portions of the upper reaches of the pads against the contacting interior portions of the lower reaches of the pads so as to provide added cushioning for the interior portion of the lower reaches and to position the interior portions of the lower reaches closer to the surface to be scrubbed.

9. The combination of claim 8 wherein the frame support means comprises a wire frame member tapered toward the ends thereof and having a transverse, central reinforcing bar connecting said frame members to said handle, the wire frame member being adapted to support said pair of steel wool pads, one on either side of the reinforcing bar.

10. The combination of claim 9, wherein the rigid plate means comprises a plate tapered toward its end portions, said plate being adapted for movement towards and away from the wire member, whereby the steel wool pads may be slipped onto or removed from the wire frame member when the rigid plate is spaced from the wire frame member.

11. A scrub-tool holder for a pair of steel wool pads each having upper and lower reaches and a slit through the center thereof defining overlying interior portions, said scrub-tool holder comprising an elongated handle, an oval wire frame support means having a transverse central reinforcing bar at one end of said handle, said frame support means being adapted to extend through the slits in the pads so as to engage the edge walls of said slit and support said pads one on either side of the reinforcing bar, thereby leaving substantially all of the overlying interior portions of the upper and lower reaches of the pads in contact with one another, and clamping means for holding said pads fixed to said frame support means, said clamping means comprising rigid plate means mounted on the handle for reciprocal movement, towards and away from the support means and adapted to engage the upper reaches of the pads for holding the pads between said clamping means and said frame support means and for urging the overlying interior portions of the upper reaches of the pads against the contacting interior portions of the lower reaches of the pads so as to provide added cushioning for the interior portions of the lower reaches and to position the interior portions of the lower reaches closer to the surface to be scrubbed.

* * * * *